US007627275B2

(12) United States Patent
Fish et al.

(10) Patent No.: US 7,627,275 B2
(45) Date of Patent: Dec. 1, 2009

(54) PROPERTIES OF TONER SUPPLY MEMBERS FOR CONTROLLING TONER LAYER THICKNESS IN AN IMAGE FORMING DEVICE

(75) Inventors: Gerald Lee Fish, Lexington, KY (US); Sean D. Smith, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 308 days.

(21) Appl. No.: 11/169,904

(22) Filed: Jun. 29, 2005

(65) Prior Publication Data

US 2007/0003327 A1 Jan. 4, 2007

(51) Int. Cl.
*G03G 15/08* (2006.01)

(52) U.S. Cl. ..... 399/281

(58) Field of Classification Search ..... 399/281, 399/272

See application file for complete search history.

(56) References Cited

U.S. PATENT DOCUMENTS

| | | | | |
|---|---|---|---|---|
| 5,339,141 | A * | 8/1994 | Suzuki et al. | 399/285 |
| 5,557,060 | A | 9/1996 | Okada et al. | |
| 5,655,197 | A * | 8/1997 | Okada et al. | 399/281 |
| 5,768,668 | A * | 6/1998 | Shiraki et al. | 399/281 |
| 6,813,470 | B1 * | 11/2004 | Elbert et al. | 399/381 |
| 2001/0009618 | A1 * | 7/2001 | Ohgoshi et al. | 399/103 |
| 2004/0259966 | A1 * | 12/2004 | Lovette | 521/82 |

* cited by examiner

*Primary Examiner*—Quana M Grainger
(74) *Attorney, Agent, or Firm*—David D. Kalish

(57) ABSTRACT

Embodiments for toner supply members, particularly toner supply member properties and architectures for controlling toner layer thickness supply to the developer member in image forming devices. In one embodiment the toner supply members have a foamed elastic body.

30 Claims, 4 Drawing Sheets

PROPERTIES OF TONER SUPPLY MEMBERS FOR CONTROLLING TONER LAYER THICKNESS IN AN IMAGE FORMING DEVICE

FIELD OF THE INVENTION

The present invention is directed generally to embodiments in the field of image forming devices, and more particularly to embodiments of toner supply member properties and architectures for controlling toner layer thickness supply to the developer member in image forming devices.

BACKGROUND

One step in the electrophotographic printing process typically involves a toner supply member of a toner cartridge providing a relatively uniform layer of toner to a developer member. The developer member in turn supplies that toner to a photoconductive element to develop a latent image thereon. The toner layer supplied by the toner supply member to the developer member is often much greater than what is required for quality image formation. A doctor blade "doctors" this layer into an acceptable thickness prior to supply to the photoconductive element.

In an image forming device the toner supply member is typically considered to have two primary functions. The first is to remove undeveloped toner from the developer member. The second is to supply a sufficient and consistent quantity of uniformly charged toner to the developer member surface prior to the doctor blade.

While the surface properties of the developer member and the doctor blade have long been known to be factors in the control of the toner layer on the developer member, it has been discovered that the properties and architecture of the toner supply member are also a factor in controlling the thickness of the toner layer supplied to the developer member.

SUMMARY

The present invention relates to embodiments for toner supply members, particularly toner supply member properties and architectures for controlling toner layer thickness supply to the developer member in image forming devices. In one embodiment the toner supply members have a foamed elastic body.

DETAILED DESCRIPTION

The present invention relates to embodiments for toner supply members, particularly toner supply member properties and architectures for controlling toner layer thickness supplied to the developer member in image forming devices.

Figure 1:
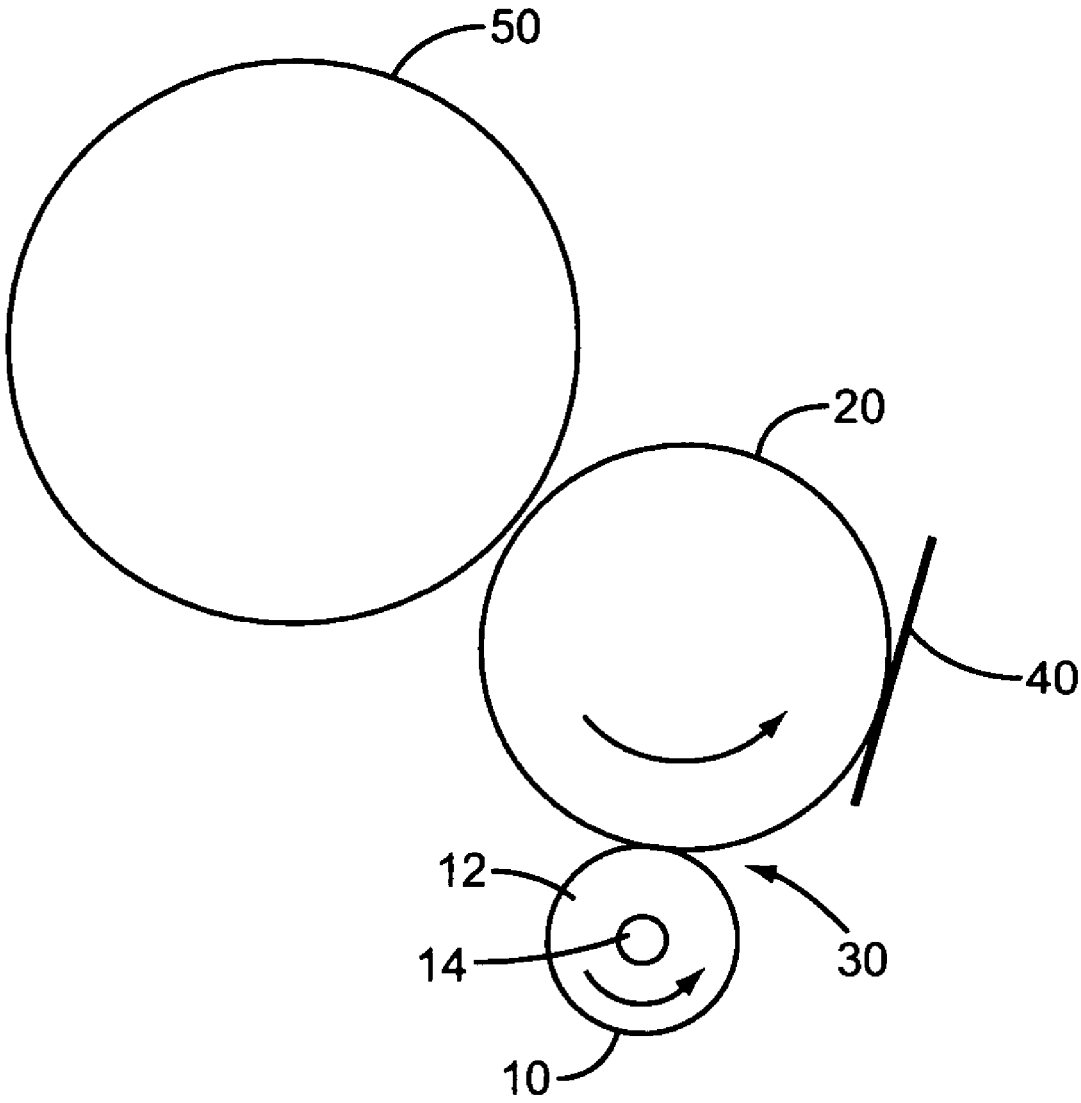
FIG. 1 is a schematic illustration of the toner supply member and developer member in accordance with one embodiment of the present invention.

FIG. 1 illustrates the positions of several elements within the toner transfer mechanism of an image forming device. The toner supply member 10 transfers toner to the developer member 20. In one embodiment, the toner supply member 10 has a foamed elastic body 12 disposed about a central shaft 14. In this embodiment, the toner supply member 10 is positioned generally parallel to a developer member 20. The toner supply member 10 and developer member 20 interface at a toner supply member-developer member nip 30 (hereinafter referred to as developer member nip) where toner is transferred. The developer member next rotates past a doctor blade 40 that more accurately regulates the amount of toner on the surface of the developer member 20. The developer member 20 with regulated toner amount then rotates past a photoconductive member 50 where the toner is transferred to an electrostatic latent image formed on the surface of the member 50.

Five primary properties of the toner supply member foam body and the developer member nip architecture influence the toner layer thickness supplied to the developer member 20. These five primary properties are: (1) the cell size of the toner supply member foam body 12; (2) the porosity of the toner supply member foam body 12; (3) the electrical resistance of the toner supply member foam body 12; (4) the nip width between the toner supply member 10 and the developer member 20; and (5) the surface velocity ratio between the toner supply member 10 and the developer member 20.

These properties directly affect the number of contacts the toner supply member foam body 12 has with toner at the developer member nip 30. The greater the number of contacts between the toner supply member 10 and toner at the developer member nip 30, the greater the control of the toner layer thickness supplied to the developer member 20.

Porosity is defined as the density of the foamed material divided by the density of the material that constitutes the solid portion of the foam. As such, it is a measure of the percentage of void volume in a unit volume of foam. In one embodiment the toner supply member foam body 12 is comprised of cells that are defined by the bubble diameter during the foam formation process. Within these cells may be many pores that are defined by the cell structure. There may, or may not, be wall material in the pores. Porosity is a function of cell size (often referred to as cell diameter) and cell spacing (often referred to in terms of pores per inch (ppi)).

A commonly cited foam property is compression force deflection (CFD). CFD is one test method to determine the load bearing capacity (firmness or stiffness) of a foam body, and may be expressed in pounds force per square inch (psi) at a given percent deflection of the foam body. Most resilient foams exhibit CFD properties that follow Hooke's Law. That is, the further they are compressed, the harder they push back against whatever is compressing them.

CFD may be measured by driving a circular indenter plate into a foam sample, stopping when the plate reaches a deflection of twenty-five percent (25%) of the foam sample thickness. The force in pounds required to hold this foam indented after one minute is recorded. The higher the force reading, the higher the load bearing capacity of the foam. The CFD value may also be reported in metric units and the foam sample size may be varied.

Foam bodies having high CFD values are often thought to improve the cleaning of toner from the developer member at the expense of developer member torque. This may be evidenced by an increase in developer member torque with the higher CFD foam body.

Figure 2:
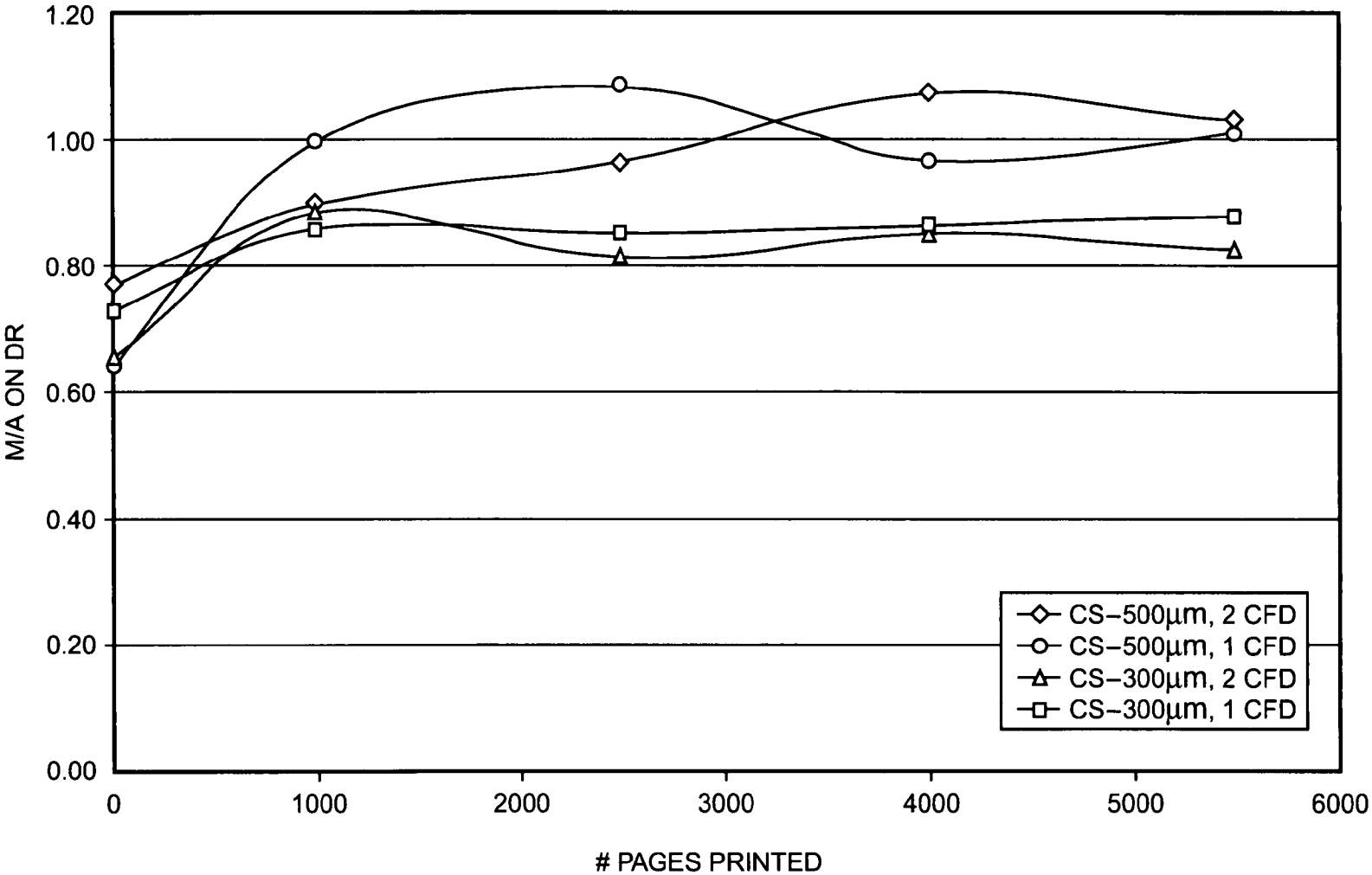
FIG. 2 is a graphical illustration of pore size and foam stiffness (CFD) and the control of toner layer thickness supplied to the developer member in accordance with one embodiment of the present invention.

In FIG. 2, there is shown a graphical illustration of cell spacing and CFD, in terms of the control of the toner layer thickness stability over life of the foam, as measured by the toner mass per unit area (M/A) on the developer member surface. Four toner supply member foams were examined:

(1) Toner supply member foam body having a foam CFD of about 2 psi, and a cell size of about 500 microns;

(2) Toner supply member foam body having a foam CFD of about 1 psi, and a cell size of about 500 microns;

(3) Toner supply member foam body having a foam CFD of about 2 psi, and a cell size of about 300 microns; and (4) Toner supply member foam body having a foam CFD of about 1 psi, and a cell size of about 300 microns.

As FIG. 2 shows, toner supply foam bodies with smaller cell size may exhibit greater control of toner layer thickness throughout their life than toner supply foam bodies with larger cell size. This may be true regardless of the CFD of the toner supply member foam body. Thus, the smaller the cell size of the toner supply member foam body 12, the greater the number of contacts with toner per linear millimeter in the developer member nip 30. The greater the number of contacts, the greater the control of the toner layer thickness in the nip. In one embodiment the cell size of the toner supply member foam body 12 is in a range of about 250 microns to about 900 microns. In another embodiment the cell size is in a range of about 300 microns to 800 microns.

The electrical resistance of the toner supply member foam body 12 needs to be sufficiently low (in combination with the voltage differential between the toner supply member and the developer member) to supply enough current to the developer member nip 30 to fully supply and charge the toner to the developer member 20. In one embodiment the toner supply member foam body 12 may have a resistance less than or equal to about 1E9 ohms.

A nip is a relatively uniform pressure zone created between two roll surfaces forced together by pressure. In one embodiment, a nip is formed between two parallel roll surfaces. Nip width is the width of mating surfaces between the two rolls. In one embodiment nip width between the toner supply member 10 and the developer member 20 may be controlled by the diameter of the toner supply member 20, the diameter of the developer member 20, and the nominal center to center distance between the two.

Foam body density may be defined as mass per unit volume and may be expressed as pounds per cubic foot (lbs/ft$^3$). Thus, the foam body density may be expressed as a measure of the weight of a cubic foot of the foam. Foam body density is directly proportional to the porosity of the foam. Foam body density may not be a measure of the firmness, stiffness, or load bearing capacity of the foam body 12. The firmness, stiffness or load bearing capacity of the foam body 12 may be measured by compression force deflection (CFD) as described above.

In one embodiment the toner supply member foam body 12 has a density in a range of about 2 pounds per cubic foot to about 8 pounds per cubic foot.

Figure 3:
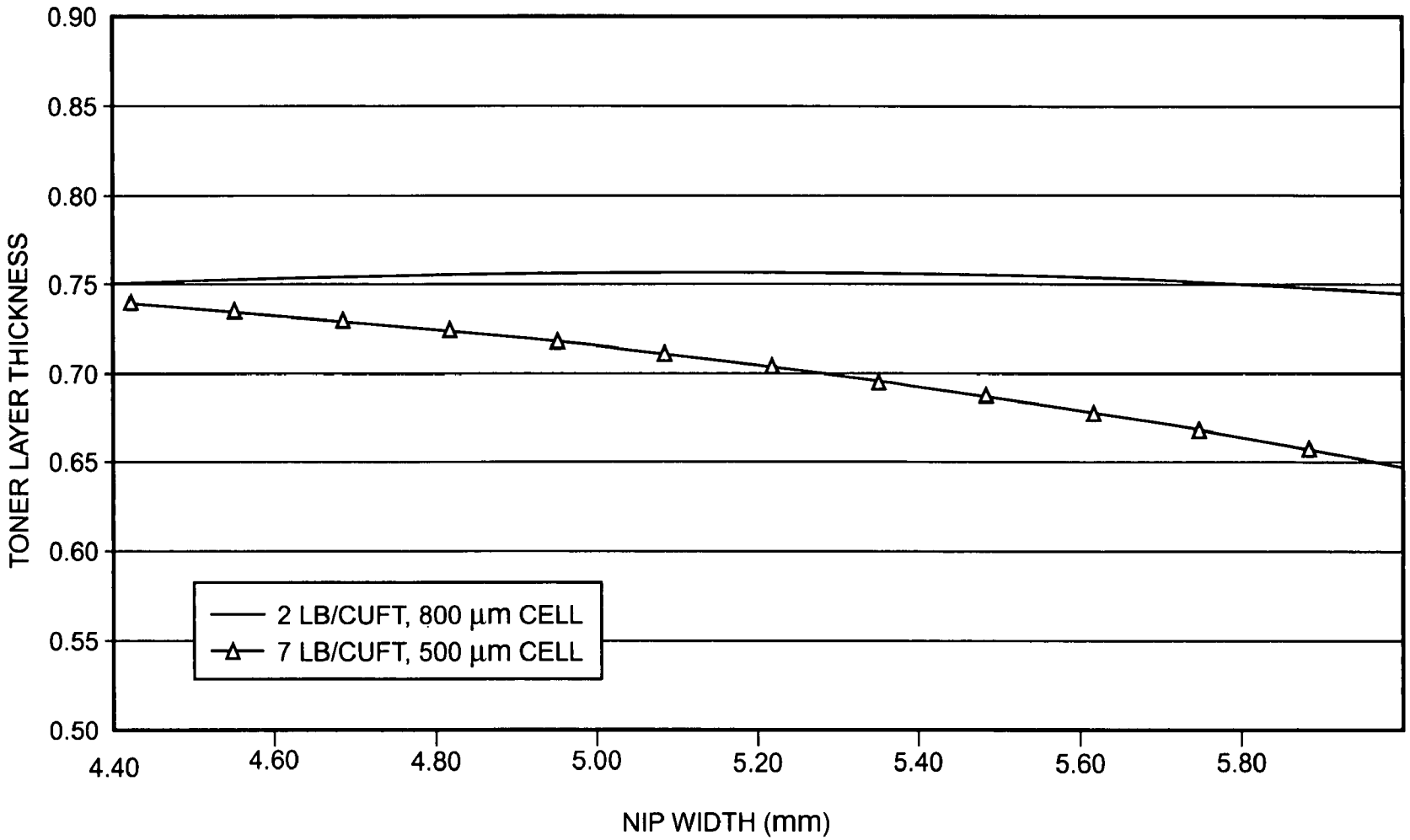
FIG. 3 is a graphical illustration of nip width and the control of toner layer thickness supplied to the developer member in accordance with one embodiment of the present invention.

FIG. 3 shows the effect of nip width on the thickness of toner layer supplied to the developer member 20. In one embodiment the nip width of a toner supply member 10 with a diameter of about 12.0 mm and a developer member 20 with a diameter of about 15.1 mm was controlled by adjusting the nominal center to center distance between the two members. The toner utilized was 9 μm conventionally milled toner, and the doctor blade 30 was a check mark type set at about 11 N of force. Surface velocity ratio, the ratio between the relative surface speeds of the toner supply member 10 versus the developer member 20 at the developer member nip 25, was about 0.8.

Two toner supply member foam bodies 12 were examined. In one embodiment the toner supply member foam body 12 had a density of about 2 lbs./ft$^3$ and about a 800 μm cell size. In one other embodiment the toner supply member foam body 12 had a density of about 7 lbs./ft$^3$ and about a 500 μm cell size.

As illustrated in FIG. 3, nip width may have little effect when the toner supply member foam body density is about 2 lbs/ft$^3$ and the cell size is about 800 um. However with a density of about 7 lbs/ft$^3$ and a cell size of about 500 um there may be about a fifteen percent (15%) reduction in toner layer thickness between a nip width of about 0.7 mm and a nip width of about 1.3 mm. This data suggests that the nip width and foam body density may be interdependent, giving additional control over toner layer thickness. Thus, parameters of the toner supply member foam body 12 may not be considered in isolation.

In one embodiment the nip width between the toner supply member 10 and the developer member 20 may be in a range from about 0.5 mm to about 1.5 mm. In another embodiment the nip width may be in a range of about 0.7 mm to about 1.3 mm.

The surface velocity ratio refers to the ratio between the relative surface speeds of the toner supply member 10 versus the developer member 20 at the developer member nip 30. In one embodiment, the toner supply member 10 and the developer member 20 rotate in the same direction within an image forming apparatus as illustrated in FIG. 1. In this embodiment the surfaces of the toner supply member 10 and the surface developer member 20 oppose one another at the developer member nip 30 even though the toner supply member 10 and the developer member 20 are rotating in the same direction. If the toner supply member 10 and the developer member 20 are rotating at different speeds this may result in opposing surface velocities between the toner supply member 10 and the developer member 20 at the developer member nip 30.

The opposing surface velocities at the developer member nip 30 may improve the ability of the toner supply member 10 to scrub toner from the surface of the developer member 20. The opposing surface velocities may also increase the number of contacts between the toner supply member 10 and toner in the nip 30. This effect of the opposing surface velocities may be less significant as the foam density of the toner supply member foam increases and cell size decreases.

In one embodiment the surface velocity ratio between the toner supply member 10 and the developer member 20 ranges from about 0.5 to about 1.0. In another embodiment the surface velocity ratio is about 0.875.

Figure 4:
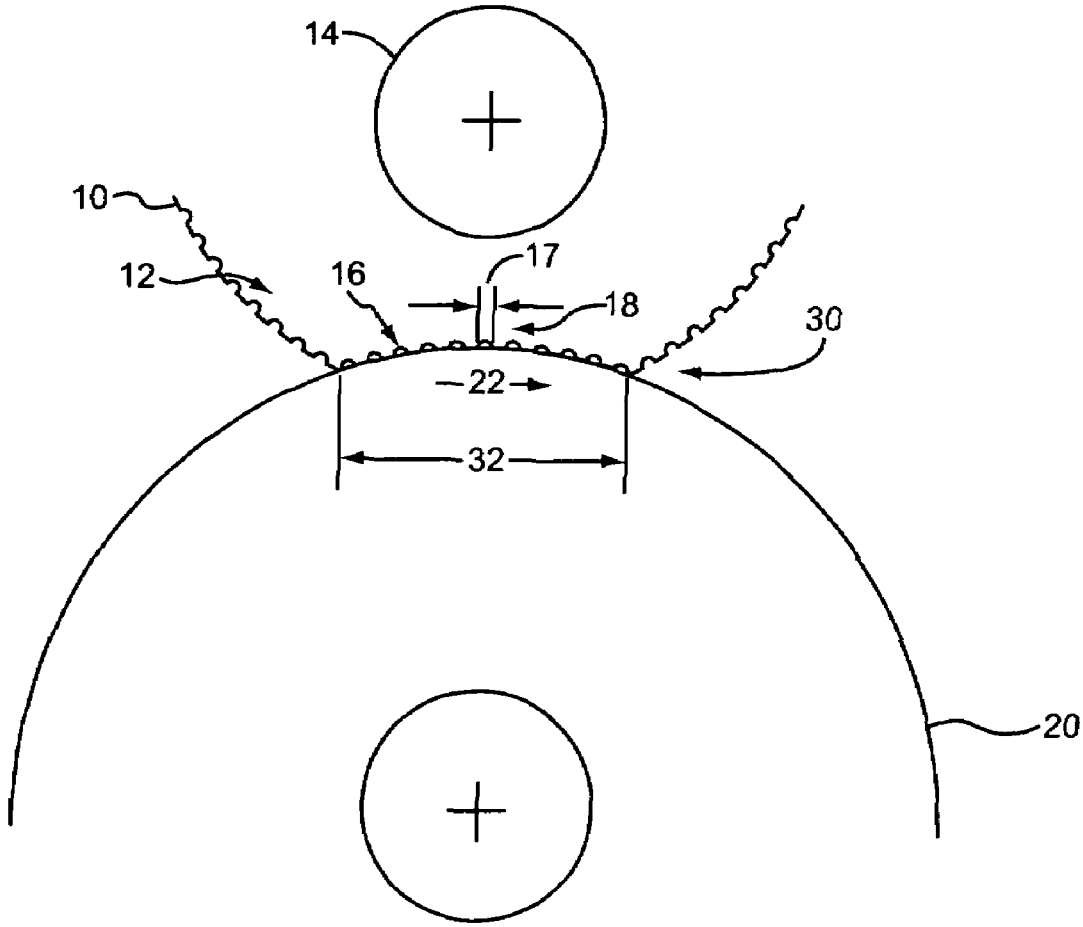
FIG. 4 is a schematic view illustrating the toner supply member-developer member nip in accordance with one embodiment of the present invention.

A mathematical model may illustrate the relationship between the previously described foam properties and architecture with the performance of a toner supply member foam body 12 in an image forming device. With reference to FIG. 4 variables of the mathematical model may be illustrated.

The differential velocity between the velocity of the developer member (DM) 22 and the toner supply member (TSM) 18 is:

$$\Delta V = V_{DM} - V_{TSM} \qquad \text{Eqn 1}$$

This can also be expressed in terms of the surface velocity ratio (R) between the developer member 20 and the toner supply member 10:

$$\Delta V = (1+R) * V_{DM} \qquad \text{Eqn 2}$$

In Equation 2, the surface velocities of the developer member 22 and the toner supply member 18 are assumed to be in opposite directions, and the value of (R) will have a positive value. Therefore, ($\Delta V$) may be greater than ($V_{DM}$).

If ($W_{nip}$) 32 is the width of the nip, then the time that any locus on the developer member 20 spends in the developer member nip 30 against the toner supply member 10 is:

$$t_{nip} = \frac{W_{nip}}{V_{DM}} \quad \text{Eqn 3}$$

The amount of circumferential length of the toner supply member 10 that contacts this locus on the developer member 20 while it is in the developer member nip 30 is:

$$X_{TSM} = \Delta V * t_{nip} \quad \text{Eqn 4}$$

Within this length of the toner supply member 10, it is desired to know the number of contacts that touch any locus on the developer member 20 surface as it passes through the developer member nip 30. This can be approximated knowing the average cell size or cell size diameter ($D_{cell}$) 17, and the porosity of the foam (P). Here we assume that the porosity (P) can be used to estimate the ratio of the amount of toner supply member 10 material that actually touches the developer member 20 to the amount of air space "in contact" with the developer member 20:

$$N = \frac{K * P}{D_{cell}} * X_{TSM} \quad \text{Eqn 5}$$

where (K) is a foam-dependent constant of proportionality, compensating for such things as geometry differences of the foam pore structures. Constant (K) may also be used for units compensation.

Substituting ($X_{TSM}$) from Equation 4 into Equation 5 gives:

$$N = \frac{K * P}{D_{cell}} * \Delta V * t_{nip} \quad \text{Eqn 6}$$

Substituting ($\Delta V$) from Equation 2 into Equation 6 gives:

$$N = \frac{K * P}{D_{cell}} * (1 + R) * V_{DM} * t_{nip} \quad \text{Eqn 7}$$

Substituting ($t_{nip}$) from Equation 3 into Equation 7, and cancelling ($V_{DM}$) gives:

$$N = \frac{K * P}{D_{cell}} * (1 + R) * W_{nip} \quad \text{Eqn 8}$$

Finally, the unknown constant (K) can be brought to the left side of the equation, leaving all knowns on the right side of the equation, and defining a new foam property (N/K), hereinafter referred to as the contact value:

$$\frac{N}{K} = \frac{P * (1 + R) * W_{nip}}{D_{cell}} \quad \text{Eqn 9}$$

Equation 9 demonstrates that number of foam contacts against a locus on the developer member 20 within the developer member nip 30 is directly proportional to foam porosity and nip width, increases with increasing surface velocity ratio, and is inversely proportional to cell size.

Currently, the constant (K) is undefined and the actual number of contacts made in the developer member nip is undetermined. The model, however, can be used to determine an (N/K) value for each toner supply member foam body type.

Where a toner supply member foam body 12 has an (N/K)> 2, the toner mass control and image formation performance may be adequate if the toner supply member foam body is relatively stiff.

Where a toner supply member foam body 12 has an (N/K)> 3, the toner mass control and image formation performance may be independent of the toner supply member foam body's stiffness.

There may be an upper limit to (N), where the toner supply member foam body porosity available to accumulate toner and apply it to the developer member becomes too small for adequate toner mass control and image formation performance.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to supply toner within an image forming apparatus, the device comprising:

a toner supply member; said member having a foamed elastic body comprising:

a cell size in a range of about 250 microns to about 900 microns;

a density in a range of about 2 pounds per cubic foot to about 8 pounds per cubic foot;

a porosity value in the range of about 0.12 to less than 1.0; and a resistance less than about 1E9 ohms;

and a developer member wherein a nip width shared by said toner supply member and said developer member is in a range of about 0.5 mm to about 1.5 mm, a surface velocity ratio between said developer member and said toner supply member is in a range of about 0.7 to about 1.7, and a toner contact value is greater than 2.

2. The device of claim 1 wherein said cell size is in a range of about 300 microns to about 900 microns.

3. The device of claim 1 wherein said nip width is in a range of about 0.7 mm to about 1.3 mm.

4. The device of claim 1 wherein said surface velocity ratio is about 0.875.

5. The device of claim 1 wherein said toner contact value is greater than 3 and the porosity value in the range of about 0.19 to less than 1.0.

6. A device for supplying toner within an image forming apparatus, the device comprising:

a toner supply member; said member having a foamed elastic body comprising:

a cell size in a range of about 250 microns to about 900 microns;

a density in a range of about 2 pounds per cubic foot to about 8 pounds per cubic foot;

a porosity value in the range of about 0.12 to less than 1.0; and a resistance less than about 1E9 ohms;

wherein relative to a corresponding developer member there is a nip width shared by said toner supply member and said corresponding developer member in a range of about 0.5 mm to about 1.5 mm, a surface velocity ratio between said corresponding developer member and said toner supply member is in a range of about 0.7 to about 1.7, and a toner contact value is greater than 2.

7. The device of claim 6 wherein said cell size is in a range of about 300 microns to about 800 microns.

8. The device of claim 6 wherein said toner contact value is greater than 3 and the porosity value in the range of about 0.19 to less than 1.0.

9. A device for supplying toner within an image forming apparatus, the device comprising:

a toner supply member having a foamed elastic body;

said body having a cell size in a range of about 250 microns to about 900 microns, a density in a range of about 2 pounds per cubic foot to about 8 pounds per cubic foot, a porosity value in the range of about 0.12 to less than 1.0, and a resistance less than about 1E9 ohms wherein relative to a corresponding developer member there is a nip width shared by said toner supply member and said corresponding developer member in a range of about 0.5 mm to about 1.5 mm, a surface velocity ratio between said corresponding developer member and said toner supply member is in a range of about 0.7 to about 1.7, and a toner contact value is greater than 2.

10. The device of claim 9 wherein said cell size is in a range of about 300 microns to about 800 microns.

11. The device of claim 9 wherein said toner contact value is greater than 3 and the porosity value in the range of about 0.19 to less than 1.0.

12. A device for supplying toner within an image forming apparatus, the device comprising:

a toner supply member having a foamed elastic body with a density in a range of about 2 pounds per cubic foot to about 8 pounds per cubic foot and a porosity value in the range of about 0.12 to less than 1.0, wherein relative to a corresponding developer member there is a nip width shared by said toner supply member and said developer member in a range of about 0.5 mm to about 1.5 mm, a surface velocity ratio between said developer member and said toner supply member in a range of about 0.7 to about 1.7, and a toner contact value that is greater than 2.

13. The device of claim 12 wherein said body has a cell size in a range of greater than 250 microns to less than 900 microns.

14. The device of claim 13 wherein said body has a cell size in a range of about 300 microns to about 800 microns.

15. The device of claim 12 wherein said body has a resistance less than about 1E9 ohms.

16. The device of claim 12 wherein said toner contact value is greater than 3 and the porosity value in the range of about 0.19 to less than 1.0.

17. A device for supplying toner within an image forming apparatus, the device comprising:

a toner supply member having a foamed elastic body positioned about a conductive shaft;

said body having a resistance less than about 1E9 ohms and a porosity value in the range of about 0.12 to less than 1.0, wherein relative to a corresponding developer member there is a nip width shared by said toner supply member and said corresponding developer member in a range of about 0.5 mm to about 1.5 mm, a surface velocity ratio between said developer member and said toner supply member in a range of about 0.7 to about 1.7, and a toner contact value that is greater than 2.

18. The device of claim 17 wherein said body has a cell size in a range of about 250 microns to about 900 microns.

19. The device of claim 18 wherein said body has a cell size is in a range of about 300 microns to about 800 microns.

20. The device of claim 17 wherein said body has a density in a range of greater than 2 pounds per cubic foot to less than 8 pounds per cubic foot.

21. The device of claim 17 wherein said toner contact value is greater than 3 and the porosity value in the range of about 0.19 to less than 1.0.

22. A device for supplying toner within an image forming apparatus, the device comprising:

a cellular foamed toner supply member having a conductive shaft, a cell size in a range of about 250 microns to about 900 microns, a porosity value in the range of about 0.12 to less than 1.0, and a resistance less than 1E9 ohms; and a developer member wherein:

a nip width shared with said toner supply member is in a range of about 0.5 mm to about 1.5 mm;

a surface velocity ratio between said developer member and said toner supply member is in a range of about 0.7 to about 1.7; and a toner contact value is greater than 2.

23. The device of claim 22 wherein said nip width is in a range of about 0.7 mm to about 1.3 mm.

24. The device of claim 22 wherein said surface velocity ratio is about 0.875.

25. A device for supplying toner within an image forming apparatus, the device comprising:

a toner supply member having a cellular elastic body centered about a conductive shaft, a cell size in a range of about 250 microns to about 900 microns, a porosity value in the range of about 0.12 to less than 1.0, and a resistance less than 1E9 ohms; and a developer member in contact with said toner supply member forming a nip therebetween wherein a surface velocity ratio between said developer member and said toner supply member is in a range of about 0.7 to about 1.7 and a toner contact value is greater than 2.

26. The device of claim 25 wherein said surface velocity ratio is about 0.875.

27. The device of claim 25 wherein said nip has a width in a range of about 0.5 mm to about 1.5 mm.

28. The device of claim 25 wherein said nip has a width in a range of about 0.7 mm to about 1.3 mm.

29. The device of claim 22 wherein said toner contact value is greater than 3 and the porosity value in the range of about 0.19 to less than 1.0.

30. The device of claim 25 wherein said toner contact value is greater than 3 and the porosity value in the range of about 0.19 to less than 1.0.

* * * * *

UNITED STATES PATENT AND TRADEMARK OFFICE

CERTIFICATE OF CORRECTION

PATENT NO. : 7,627,275 B2
APPLICATION NO. : 11/169904
DATED : December 1, 2009
INVENTOR(S) : Fish et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 454 days.

Signed and Sealed this

Twenty-first Day of December, 2010

David J. Kappos

David J. Kappos
*Director of the United States Patent and Trademark Office*